US007377558B2

(12) United States Patent
Schimmler

(10) Patent No.: US 7,377,558 B2
(45) Date of Patent: May 27, 2008

(54) LOCKING DEVICE

(75) Inventor: Marc Schimmler, Heinbockel (DE)

(73) Assignee: Airbus Deutschland GmbH, Hamburg (DE)

( * ) Notice: Subject to any disclaimer, the term of this patent is extended or adjusted under 35 U.S.C. 154(b) by 204 days.

(21) Appl. No.: 11/253,266

(22) Filed: Oct. 18, 2005

(65) Prior Publication Data

US 2006/0087127 A1 Apr. 27, 2006

Related U.S. Application Data

(60) Provisional application No. 60/620,077, filed on Oct. 19, 2004.

(51) Int. Cl.
*E05C 1/02* (2006.01)
*E05B 3/00* (2006.01)

(52) U.S. Cl. ..... 292/137; 292/138; 292/146; 292/150; 292/336.3; 292/DIG. 11; 292/DIG. 60; 292/DIG. 62

(58) Field of Classification Search ..... 292/137, 292/138, 143, 145, 146, 150, 173, 336.3, 292/DIG. 11, DIG. 60, DIG. 62
See application file for complete search history.

(56) References Cited

U.S. PATENT DOCUMENTS 233,711 A * 10/1880 Spencer et al. ..... 292/173
1,064,800 A * 6/1913 Whitcomb ..... 292/173
2,098,569 A * 11/1937 Curtis ..... 292/42
3,347,581 A 6/1965 Hann
3,495,862 A * 2/1970 McClintock ..... 292/173
6,053,019 A 4/2000 Wiik et al.
6,499,775 B2 12/2002 Fujiwara

FOREIGN PATENT DOCUMENTS

| | | |
|---|---|---|
| DE | 197 21 202 A1 | 12/1997 |
| DE | 601 03 941 T2 | 11/2004 |
| FR | 983870 | 6/1951 |
| GB | 2215391 A | 9/1989 |
| GB | 2255798 A | 11/1992 |
| WO | 97/09501 A1 | 3/1997 |
| WO | 97/28334 A1 | 8/1997 |

* cited by examiner

*Primary Examiner*—Carlos Lugo
(74) *Attorney, Agent, or Firm*—Christopher Paradies; Fowler White Boggs Banker P.A.

(57) ABSTRACT

A locking device contains a displaceable bolt and internal and external control components. In a normal state of the locking device, the internal control component and the external control component displace the bolt and, in an override state of the locking device, only the external control component engages the bolt in order to displace it.

12 Claims, 4 Drawing Sheets

LOCKING DEVICE

RELATED APPLICATIONS

This application claims the benefit of the filing date of German Patent Application No. 10 2004 050 932.8 filed Oct. 19, 2004 and claims the benefit of the filing date of U.S. Provisional Patent Application No. 60/620,077 filed Oct. 19, 2004, the disclosure of which is hereby incorporated herein by reference.

FIELD OF THE INVENTION

The field relates to a locking device, particularly a locking mechanism, which is usable in bathroom doors in aircraft, for example.

TECHNOLOGICAL BACKGROUND

It is a requirement in aircraft toilets that the cabin personnel must be able to have access to them without the use of tools being necessary for this purpose. For example, a person, who is locked in who may not free himself, or a person in the toilet who endangers the security of the aircraft may prevent opening.

It is understood that a person of ordinary skill will find that modifications and alterations may be made based on the summary of the invention, examples and drawings provided. For example, a different interlocking mechanism may be used, such as friction, magnetism or a mechanical latching mechanism, so long as, the mechanism is actuated from the inside during normal passenger use, but is overridden if activated from the outside.

If a person who is locked in the restroom may not free himself, it is possible with this solution that the person locked in will block the bolt, for example, by lying in front of it. If a person who endangers the security of the aircraft is in the toilet, it is possible that he or she will intentionally jam the opening mechanism with the conventional solution. In both cases, cabin personnel can only reach the person who is locked in, with difficulty.

SUMMARY OF THE INVENTION

The locking device allows for a displacment of a bolt, and may contain an internal and an external control component, which are positioned on diametrically opposite sides of the bolt. Thus, neither of the two sides (a person located in the toilet and a person located outside the toilet) may operate the bolt directly, but rather each side actuates the bolt via separately implemented control components (also denoted as control plates in the following). One may open a locked door, such as a toilet door in an aircraft, from the outside, without the bolt being able to be blocked from the inside intentionally or unintentionally.

The control plates may have pins which engage the bolt under normal circumstances. In one example, the pins of the external plate or sheet may be at least as long as the bolt is thick, while the pins of the internal control plate may be significantly shorter. Unlike the external control plate, the internal control plate may only be displaced via a mask which appears to be like the bolt itself to the operator. This mask may prevent the internal control plate from being able to be pressed into the bolt, since the mask rests on the door.

In order that the internal control plate remains in the bolt under normal circumstances, it may be pressed into the bolt by biasing elements such as two springs, an internal spring and a mask spring, which may be located between mask and internal control plate. The pins of the internal control plate may be especially pressed into holes which are implemented in the bolt. The ability to have more than one spring ensures secure use of the door even in case of spring breakage. The handle for the external control plate may be advantageously attached under a flap on the external side of the toilet door.

The bolt may be thus opened without a great expenditure of force and without an additional tool in spite of a blockade of the locking device from the inside. In one example, a normal user will not notice the concealed function of the bolt. The bolt may be opened from the outside, without being perceived from the inside. For example, such a scenario occurs if the frictional force between the mask and the door is greater than the friction between the pins of the internal control plate and the bolt.

BRIEF DESCRIPTION OF THE DRAWINGS

In the drawings identical elements in the figures are provided with identical reference numbers. Below examples are described with reference to the drawings.

FIGS. 3A-3C show the locking device 1 in a normal state. In this example, the bolt 2 may be actuated both from the outside and from the inside.

FIG. 3A illustrates closing of the bolt 2 from the inside.

FIG. 3B illustrates opening of the bolt 2 from the inside.

FIGS. 3D-3F each show a top view of the locking device 1 according to one embodiment in an override state.

DETAILED DESCRIPTION OF PREFERRED EMBODIMENTS

The locking device 1 may contain a displaceable bolt 2, which is used in order to lock and unlock a door 3. According to the one embodiment of the present invention, four holes 4A-4D are implemented in the bolt 2, which extend substantially perpendicularly to the longitudinal direction of the bolt 2, and connect the outside of the door with the inside of the door. The door outside is in the upper half of the figure and the door inside is in the lower half of the figure in FIG. 1. Substantially perpendicularly is defined as being near a 90° angle; such as in one example 88°.

Figure 1:
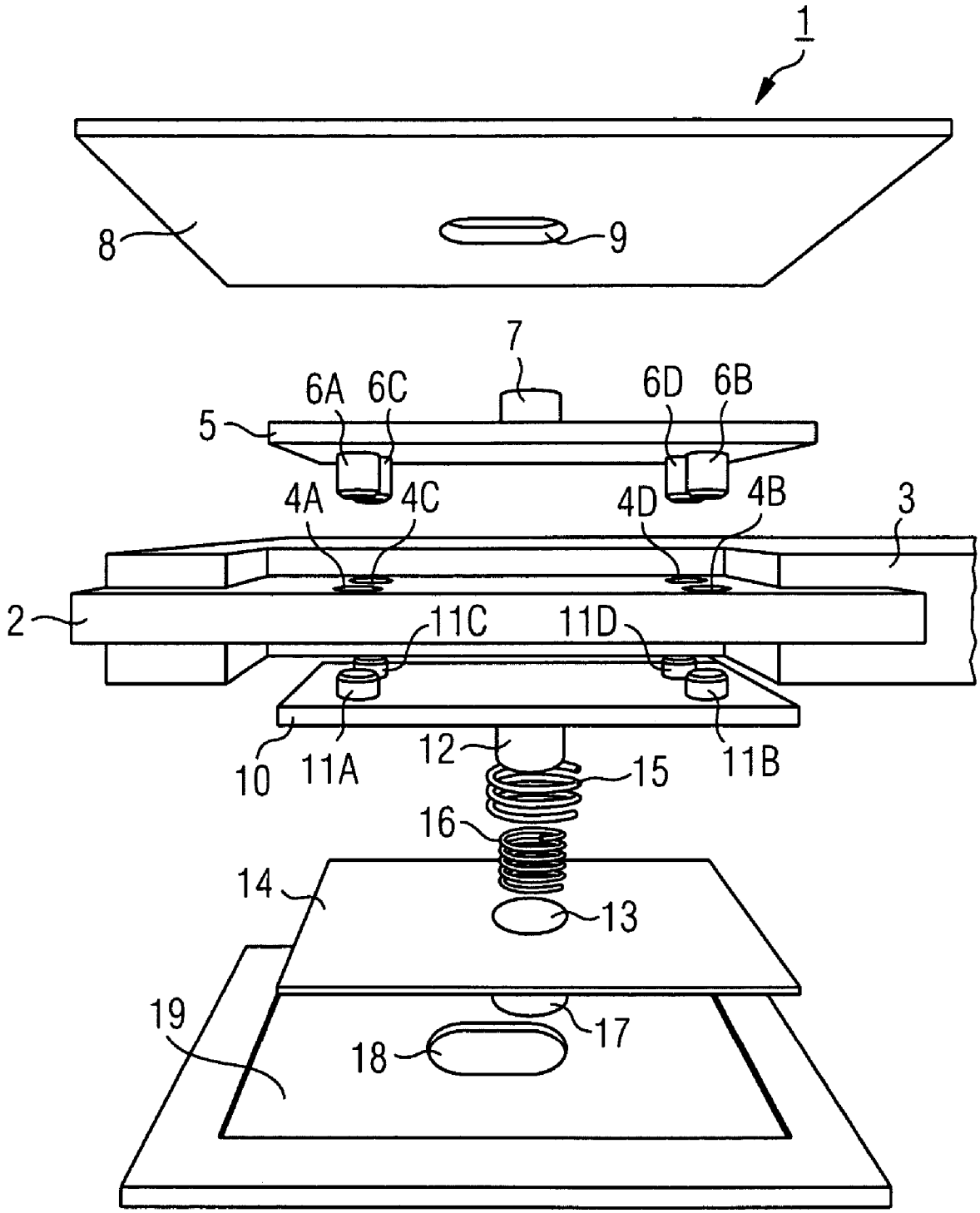
FIG. 1 shows an exploded illustration of the locking device.

FIG. 1 shows an external control component 5, which is a control plate. The external control component 5, according to one embodiment, has four pins 6A-6D which project substantially perpendicularly from a side facing away from the bolt. The number of the pins 6 corresponds to the number of the holes 4 implemented in the bolt 2. According to one embodiment, each pin 6 fits in a corresponding hole 4.

An external handle 7, which points substantially perpendicularly outward, is located on the side of the external control component 5 facing away from the bolt. In the mounted state of the locking device, this external handle 7 extends, through an opening 9 through an external cover plate 8. The opening 9, in one example is an oblong hole which is used as a guide when displacement of external control component 5 and/or the bolt 2 occurs. In the assembled state of the locking device 1, the external handle 7 extends through the oblong hole 9 and may be actuated or operated from the outside by a person. According to one embodiment, the external control component 5, the pins 6, and the external handle 7 integrally formed and are injection molded from metal or plastic, for example.

On an inner side of the door 3, the locking device 1 contains an internal control component 10. As shown in FIG. 1, the bolt 2 is located between the external control component 5 and the internal control component 10, which are both positioned on opposite sides of the bolt. The internal control component 10 may be constructed in a similar fashion as the external control component 5 and may differ from in that its four pins 11A-11D, which also extend substantially perpendicularly to the bolt 2, may be of shorter length than the pins 6A-6D of the external control component 5. According to one embodiment, the internal control component 10, the pins 11, and the projection 12 are integrally formed and injection molded from metal or plastic, for example. Similarly as with the external control component 5, the number of the pins 11A-11D of the internal control component 10 corresponds to the number of the holes 4A-4D.

In the assembled state of the locking device 1, a portion of the pins 11A, 6A may be inserted into the hole 4A; a portion of the pins 11B, 6B need only be inserted into the hole 4B; a portion of the pins 11C, 6C may be inserted into the hole 4C, and a portion of the pins 11D, 6D may be inserted into the hole 4D.

As shown in FIG. 1, a projection 12 extends externally away from the bolt 2 on a side of the internal control component 10 facing away from the bolt 2. The projection 12, in one example, is cylindrical, and conforms to a cylindrical recess 13 which is formed in a mask 14. In the assembled state of the locking device 1, the cylindrical projection 12 may be inserted into the cylindrical recess 13 of the mask 14. Other shapes are also possible for the projection 12 and the recess 13.

The mask 14 may be wider than the opening or recess for the mechanism in the door, so that no force may be exerted from the inside on the control component 10 via it, in order to press the pins into the bolt.

As shown in FIG. 1, a biasing element, such as a first spring element 15 is placed between the internal control component 10 and the mask 14. Furthermore, another biasing element such as a cylindrical spring 16, which conforms to the internal circumference of the recess 13, is inserted into the cylindrical recess 13 according to one embodiment of the mask 14. The recess 13 formed in the mask 14 has an internal handle 17 on the side of the mask 14 facing away from the door 3. This internal handle 17 projects through an aperture 18, which is formed in an internal cover plate 19, in the mounted state of the locking device. A person who is located in the interior of the toilet, uses handle 17 for actuating the bolt 2, for example. The internal control component 10 is thus actuated via the mask 14. In the mounted state of the locking device 1, the mask presses or abuts against the inside of the door, and thus prevents the movement of the internal control component 10 in the direction of the bolt 2.

Figure 2:
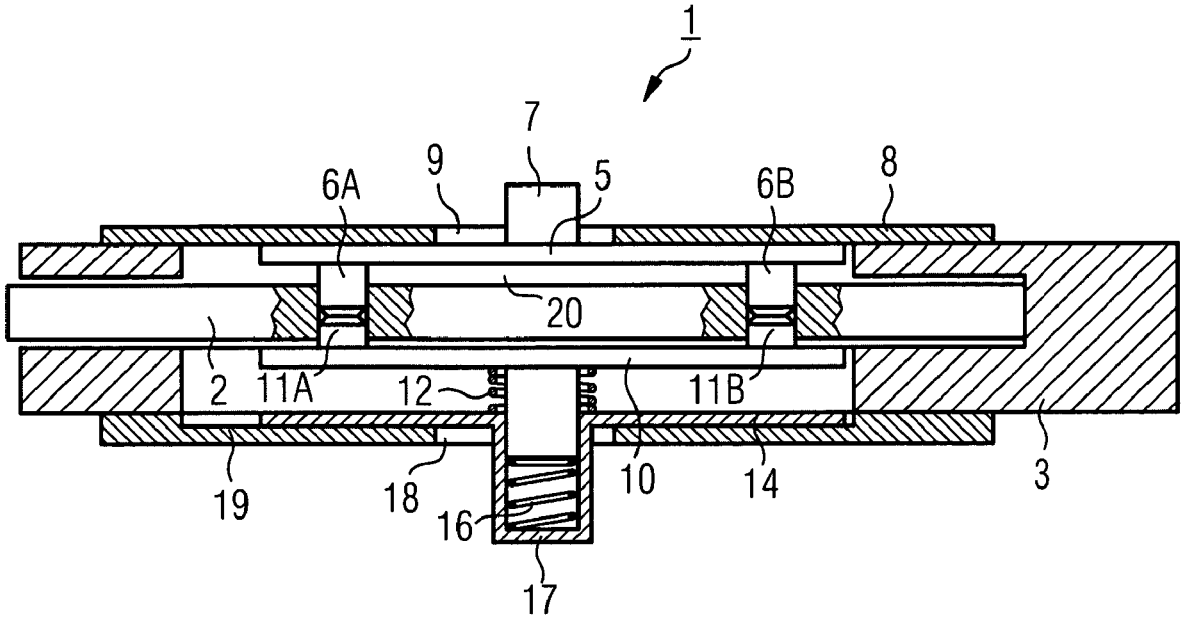
FIG. 2 shows a top view of the locking device shown in FIG. 1.

In FIG. 2, the bolt 2 is actuated and the door is locked and unlocked by displacing the external control component 5 via the handle 7 and also by displacing the internal control component 10 via the internal handle 17.

The pins 6A and 6B of the external control component 5 may be significantly longer than the pins 11A and 11B of the internal control component 10. This is may also hold true for the pins 6C, 6D and 11C, 11D, which are not shown in FIG. 2.

According to one embodiment, the length of the pins 6 of the external control component 5 is at least equal to the thickness of the bolt 2. In the normal state of the locking device 1, as shown in FIG. 2, if the external control component 5 engages with the bolt 2 via the pins 6 and the internal control component 10 engages with the bolt 2 via the pins 11, an intermediate space 20 is formed between the external control component 5 and a surface of the bolt 2 which points outward. This scenario may occur since the pins 6 and 11 are each inserted from diametrically opposite side in the holes 4. Furthermore, a portion of the pins of the internal and external control components need only be inserted into the corresponding holes.

If the bolt 2 is to be actuated from the outside and the door 3 be unlocked unnoticed, the external control component 5 is pressed in the direction of bolt 2, through which the pins 6A and 6B inserted into the hole 4 press the pins 11A and 11B of the internal control component 10 out of the holes. This action goes against the spring forces of the first biasing element 12 and the second biasing element 16. In this state, which may be referred to as an override state of the locking device 1, pushing the external handle 7 and/or the external control component 5 may displace the bolt 2 and it is not possible to prevent this displacement by holding onto the internal handle 17. Furthermore, upon displacement of the bolt 2, the internal handle 17 and/or the mask 14 are not displaced. Thus, a person located in the interior does not notice that the bolt 2 is being actuated from the outside.

Figure 3A:
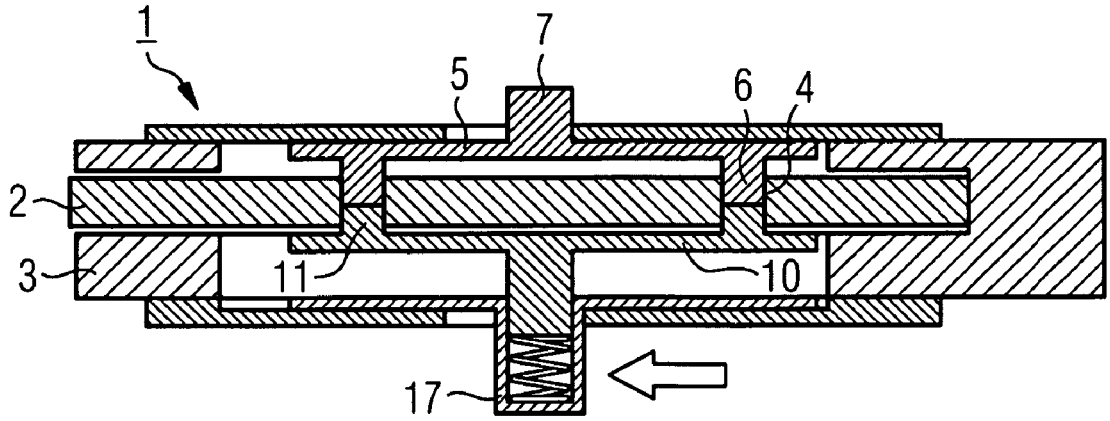
FIGS. 3A-3F each show top views of the locking device as shown in FIG. 1 in different operating states.
Figure 3B:
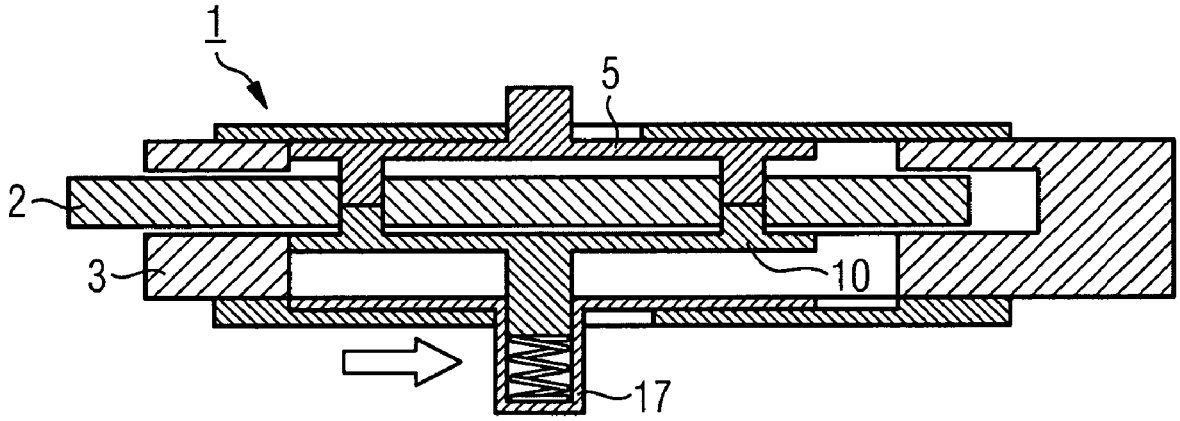
Figure 3C:
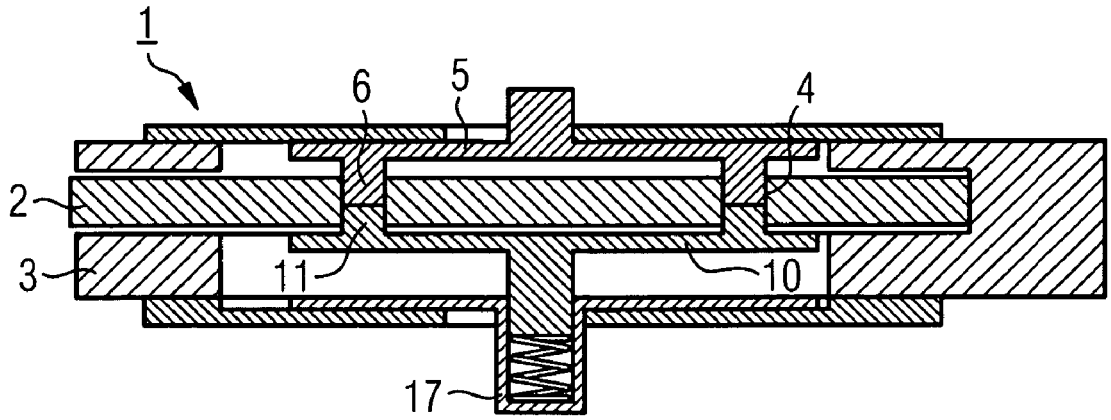

In FIG. 3C, the door is unlocked. As shown in FIGS. 3A-3C, in the normal state of the locking device 1, the pins 6 of the external control component 5 and the pins 11 of the internal control component 10 are each inserted into the holes 4 of the bolt 2 and are engaged therewith.

Figure 3D:
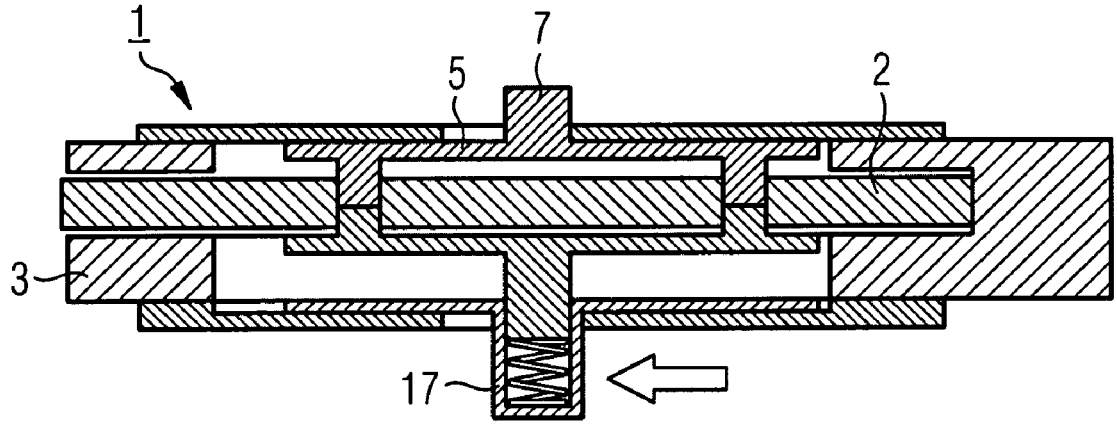

In FIG. 3D, similarly as in FIG. 3A, the bolt 2 is closed from the inside.

Figure 3E:
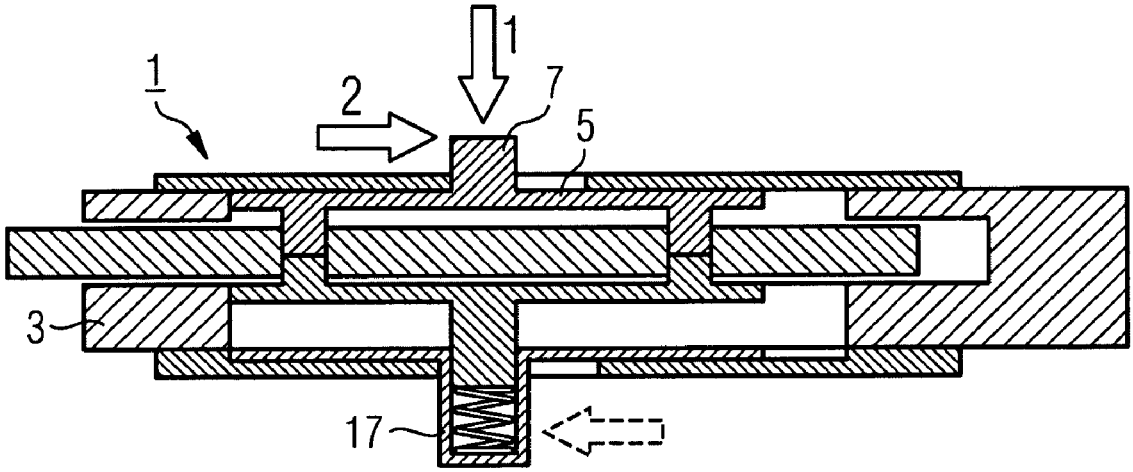

In FIG. 3E, the closed bolt 2 may be opened from the outside without being perceived and/or being able to be blocked from the inside. For this purpose, the external control component 5 may be pressed into the bolt 2 (arrow 1). The pins 11 of the internal control component 10 are pressed out of the openings 4 of the bolt 2 and are no longer engaged with the bolt 2. The pins 11 of the internal control component 10 are pressed out against the biasing force of the first and second biasing elements 15, 16. In a second step (arrow 2), the bolt may be opened from the outside. In one example, as depicted in FIGS. 3A-3F, the biasing elements may be spring elements.

Figure 3F:
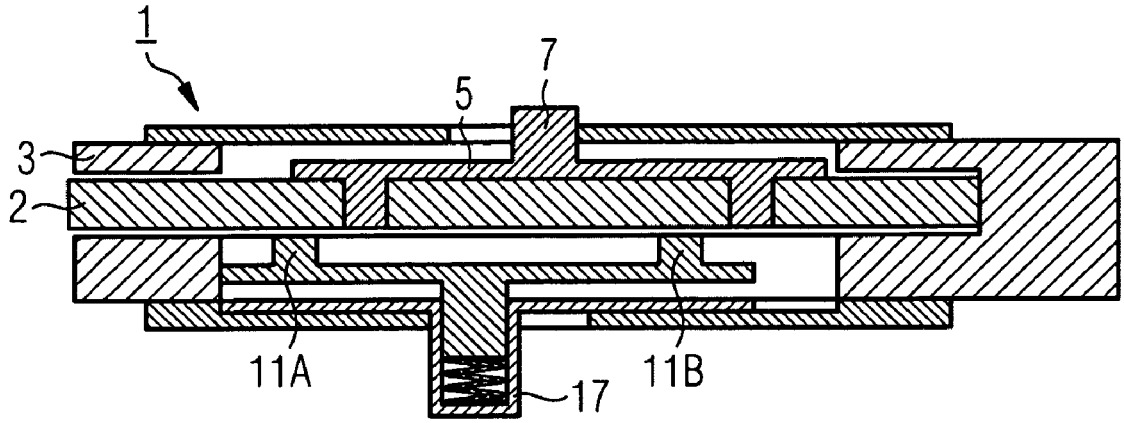

In FIG. 3F, the door is unlocked from the outside. As shown, only the pins 6 of the external control component 5 are engaged with the openings 4 of the bolt 2. In the override state, the interior control component 10 has no control over the bolt, since the pins 11 of the interior control component 10 are not engaged with the bolt 2 and the pins front faces are only pressed against an inward facing lateral surface of the bolt 2 via the biasing force of the biasing elements 15, 16. During the override, one must only work against the biasing force of the biasing elements 15, 16 when the locking device 1 is unlocked from the outside. The bolt 2 may subsequently be moved as easily as ever. If the external control component 5 is released again and moved back and forth once, the bolt 2 engages the interior control component 10 and the biasing elements 15, 16 press the pins 11 back into the holes 4 of the bolt 2. For this purpose, for example, a spring element is to be provided between the external control component 5 and the bolt 2.

It is understood that modifications and alterations may be performed as long as it is ensured that in a normal state, the bolt may be actuated both from the inside and from the outside and, in an override state, control of the bolt is only possible from the outside.

An example is shown in the drawing that provides such a mechanism in the door of an aircraft restroom; however such a mechanism may also be used for bolts in doors of hospitals, senior care facilities, kindergartens, and other places where an external overriding access is desired.

It should be noted that the term "comprising" does not exclude other elements or steps and the "a" or "an" does not exclude a plurality. Also elements described in association with different embodiments may be combined.

It should also be noted that reference signs in the claims shall not be construed as limiting the scope of the claims.

LIST OF REFERENCE NUMBERS

1 locking device
2 bolt
3 door
4A-4D through hole
5 external control component
6A-6D pin
7 external handle
8 cover plate
9 opening
10 internal control component
11A-11D pin
12 projection
13 cylindrical recess
14 mask
15 first spring element
16 second spring element
17 internal handle
18 opening
19 internal cover plate

What is claimed:

1. A locking device comprising a displaceable bolt having at least one through hole;

an internal control component comprising at least one internal control component pin; and an external control component comprising at least one external control component pin;

wherein the internal control component and the external control component are positioned on opposite sides of the displaceable bolt, and in a normal state of the locking device, the at least one internal control component pin and the at least one external control component pin are both at least partially inserted into a respective at least one through hole of the displaceable bolt, such that the internal control component and the external control component engage the displaceable bolt in order to displace the displaceable bolt, and in an override state of the locking device, only the at least one external control component pin engages the displaceable bolt in order to displace the displaceable bolt it.

2. The locking device of claim 1, wherein the at least one external control component pin extends away from a surface of the external control component and the at least one internal control component pin extends away from a surface of the internal control component such that the at least one external control component pin and the at least one internal control component pin are capable of coupling with the at least one through hole of disposed in the displaceable bolt.

3. The locking device of claim 2, wherein the at least one external control component pin or the at least one internal control component pin has a length equal to at least the thickness of the displaceable bolt.

4. The locking device of claim 3, wherein the at least one through hole comprises four holes in the displacement bolt, the at least one internal control component comprises four pins and the at least one external control component comprises four pins and the four holes are disposed engagingly respectively for each of the internal control and the external control component pins.

5. The locking device of claim 4, wherein, in the override state, the at least one external control component pin displaces the at least one internal control from the at least one through hole, and only the at least one external control component pin engages the displaceable bolt.

6. A door comprising a locking device of claim 1 and a flap, the flap concealing a handle coupled to the external control component.

7. The door of claim 6, wherein the handle is coupled with the external control component such that the handle is capable of displacing the bolt.

8. A locking device comprising a displaceable bolt;

an internal control component;

an external control component;

wherein the internal control component and the external control component are positioned on opposite sides of the displaceable bolt, and in a normal state of the locking device, the internal control component and the external control component engage the displaceable bolt in order to displace the displaceable bolt, and in an override state of the locking device, only the external control component engages the displaceable bolt in order to displace the displaceable bolt; and a biasing element coupled with the internal control component and biasing at least a portion of the internal control component in a direction towards the displaceable bolt.

9. The locking device of claim 8, wherein the biasing element is a spring.

10. The locking device of claim 8, wherein, the at least a portion of the internal control component is a pin, and in the normal state, the biasing element applies a biasing force on the pin such that the pin engages the displaceable bolt, and in the override state, the biasing element presses a front face of the pin against a lateral surface of the displaceable bolt.

11. A door comprising a locking device of claim 8, and a flap, the flap concealing a handle coupled to the external control component.

12. The door of claim 11, wherein the handle is coupled with the external control component such that the handle is capable of displacing the bolt.

* * * * *